US010597957B2

(12) United States Patent
Gubbins et al.

(10) Patent No.: US 10,597,957 B2
(45) Date of Patent: Mar. 24, 2020

(54) FOLDABLE CONTINUOUS ROD GUIDE AND A JIB FOR SERVICING RIG FOR SUPPORTING SAME

(71) Applicant: Celtic Machining Ltd., Rainier (CA)

(72) Inventors: Martin E. C. Gubbins, Rainier (CA); Sven W. Larsen, Rainier (CA)

(73) Assignee: Celtic Machining Ltd, Rainer (CA)

( * ) Notice: Subject to any disclaimer, the term of this patent is extended or adjusted under 35 U.S.C. 154(b) by 98 days.

(21) Appl. No.: 15/709,817

(22) Filed: Sep. 20, 2017

(65) Prior Publication Data

US 2019/0085647 A1 Mar. 21, 2019

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 6,695,048 B2 * 2/2004 Andersen ..... E21B 19/22 166/77.1
6,830,101 B2 * 12/2004 Saheta ..... E21B 19/22 166/77.2
6,880,630 B2 * 4/2005 Widney ..... E21B 19/22 166/77.53
7,036,578 B2 * 5/2006 Austbo ..... E21B 19/22 166/77.2
8,006,752 B2 * 8/2011 Basler ..... E21B 19/22 166/75.11
9,581,009 B2 * 2/2017 Steffenhagen ..... E21B 17/20
2009/0025980 A1 * 1/2009 Callander ..... E21B 15/003 175/45

* cited by examiner

*Primary Examiner* — Matthew R Buck
(74) *Attorney, Agent, or Firm* — Kyle R Satterthwaite; Ryan W Dupuis; Ade & Company Inc.

(57) ABSTRACT

An foldable guide for a continuous rod injector features first and second segments of similar length and a shorter third segment. In a fully folded state of the guide, the shorter third segment is foldable into a position contained between facing-together concave sides of the first and segments for improved collapse of the guide into a compact state for storage or transport. A proximal end of the first segment is mounted to the injector, which is carried on a mast having a selectively deployable jib thereon at an elevation above the installed position of the injector. The jib is movable between a slant-mode condition reaching outward from the mast and a vertical-mode position retracted into a more compact relation with the mast. The slant-mode condition provides improved support and stability by providing a more direct overhead support for the rod guide in slant well applications.

16 Claims, 16 Drawing Sheets

FOLDABLE CONTINUOUS ROD GUIDE AND A JIB FOR SERVICING RIG FOR SUPPORTING SAME

FIELD OF THE INVENTION

The present invention relates generally to equipment for servicing wells with continuous rod, and more particularly to a foldable guide collapsible into a compact form when not in use to guide continuous rod into an injector, and a servicing rig whose mast carries a selectively deployable jib for better support and stabilization of the guide.

BACKGROUND

It has been previously known to provide well string injectors with foldable guides for guiding continuous well strings into the injector from a supply reel. U.S. Pat. No. 8,006,752 discloses a guide tube for continuous rod that is unfolded from a compact storage position on the erected mast of a servicing rig through a combination of manual guide rope and winchline operations. U.S. Pat. No. 6,830,101 discloses a coiled tubing guide formed of arc-shaped segments that are foldable up alongside one another in side-by-side planes by hydraulic cylinders connected between the segments for compact storage and transport of the segments in horizontal orientations atop the injector. U.S. Pat. Nos. 6,695,048 and 7,036,578 also disclose segmented coiled tubing guides, but without means for folded-collapse thereof during periods of storage or transport.

U.S. Pat. No. 6,880,630 teaches a tension device straddling a point at which a continuous well string guide is suspended from the mast of the rig in order to stabilize the injector against lateral movement, but again lacks means for folded-collapse during periods of storage or transport.

There remains room for alternatives and improvements in the area of collapsible guides for continuous well strings and stabilization of such guides during use.

SUMMARY OF THE INVENTION

According to a first aspect of the invention, there is provided an apparatus for guiding continuous rod into a continuous rod injector, said apparatus comprising:

a plurality of segments each having an arc shape and proximal and distal ends spaced apart along said arc shape, said plurality of segments including:

- a first segment connected or connectable to the continuous rod injector at the proximal end of said first segment;
- a second segment having a similar length to the first segment, the proximal end of said second segment being pivotally coupled to the distal end of the first segment by a first pivot joint; and
- a third segment having a shorter length than each of the first and second segments, the proximal end of said third segment being pivotally coupled to the distal end of the second segment by a second pivot joint;

the second segment being movable about the first pivot joint between a stowed position reaching back toward the proximal end of the first segment on a concave side of the first segment's arc shape and placing the distal end of the second segment adjacent the proximal end of the first segment with a concave side of the second segment facing the concave side of the first segment, and a deployed position extending away from the proximal end of the first segment at the distal end of said first segment to form an extension of the first segment's arc shape; and the third segment being movable about the second pivot joint between a folded position reaching back toward the proximal end of the second segment on the concave side of the second segment's arc shape and an unfolded position extending away from the proximal end of the second segment at the distal end thereof to form an extension of the second segment's arc shape, the third segment being arranged to fit, in the folded position thereof, between the concave sides of the first and second segments in the stowed position of the second segment.

Preferably there is a first actuator operably connected between the first and second segments to effect movement of the second segment between the stowed and deployed positions, and a second actuator operably connected between the second and third segments to effect movement of the third segment between the folded and unfolded positions.

Preferably the first actuator comprises a first hydraulic linear actuator having opposite ends thereof pinned to the first and second segments, and the second actuator comprises a second hydraulic linear actuator having opposite ends thereof pinned to the second and third segments.

Preferably at least one of the segments comprises separate first and second sections and a swivel connection joining said first and second sections and enabling relative rotation therebetween about a longitudinal axis of said segment.

Preferably said at least one of the segments comprises the second segment, and the first and second actuators are respectively connected to said first and second sections of the second segment on opposite sides of the swivel connection.

Preferably there is a bracket mounted on the first segment proximate the proximal end thereof and extending to the concave side of the first segment's arc-shape for receiving a proximal portion of the third segment in the folded position when the second segment is moved into the stowed position.

Preferably there is also a bracket mounted on the second segment proximate the proximal end thereof and extending to the concave side of the second segment's arc-shape to receive a distal portion of the third segment in the folded position.

Preferably each segment comprises hollow tubing of longitudinally arc-shaped curvature and which is sized for passage of the continuous rod longitudinally through said tubing.

Preferably there is a mast and a continuous rod injector supported on the mast at an installed position thereon, wherein the proximal end of the first segment is mounted to the continuous rod injector to guide continuous rod thereinto, the mast having a selectively deployable jib thereon at an elevation above the installed position of the injector, the jib being movable between a slant-mode condition reaching outward from the mast and a vertical-mode position retracted into a more compact relation with the mast.

Preferably there is at least one winchline, said at least one winchline being connectable to the rod guide and selectively usable in both a vertical well mode pulling upwardly on the rod guide from an elevated location on the mast with the mast in a generally vertical upright orientation, and a slant well mode pulling upwardly on the rod guide from an outboard location on the deployed jib with the mast in an inclined orientation from which the deployed jib reaches outward to the outboard point at an area situated more directly overhead of the apparatus.

According to a second aspect of the invention, there is provided a method of folding up the apparatus from the first aspect of the invention for storage between uses thereof, the method comprising moving the third segment into the folded position relative to the second segment, and moving the second segment into the stowed position relative to the first segment, thereby placing the third second between the concave sides of the first and segment segments.

Preferably, moving the second segment into the stowed position comprises initiating movement of the second segment relative to the first segment only after the third segment has achieved the folded position relative to the second segment.

According to a third aspect of the invention, there is provided a method of unfolding the apparatus from the first aspect of the invention use thereof, the method comprising moving the second segment out of the stowed position into the deployed position, and moving the third segment into the unfolded position, thereby withdrawing the third segment out from between the concave sides of the first and second segments.

Preferably, moving the third segment into the unfolded position comprises initiating movement of the third segment relative to the second segment only after at least partial deployment of the second segment relative to the first segment to create sufficient space between the concave sides of the first and second segments for movement of the third segment relative to the second segment.

According to a fourth aspect of the invention, there is provided an apparatus for servicing a well, said apparatus comprising:

a mast;

an injector supported on the mast at an installed position thereon for injecting a continuous well string into a wellbore;

a guide coupled to the injector to guide the continuous well string between a reel and said injector; and a selectively deployable jib on the mast at an elevation above the installed position of the injector, the jib being movable between a slant-mode condition reaching outward from the mast and a vertical-mode position retracted into a more compact relation with the mast; and at least one winchline, said at least one winchline being connectable to the rod guide and selectively usable in both a vertical well mode pulling upwardly on the rod guide from an elevated location on the mast with the mast in a generally vertical upright orientation, and a slant well mode pulling upwardly on the rod guide from an outboard location on the deployed jib with the mast in an inclined orientation from which the deployed jib reaches outward to the outboard point at an area situated more directly overhead of the apparatus.

Preferably the at least one winchline comprises a singular winchline routed through a guide point on the jib that resides at the outboard location when the jib is deployed to the slant-mode condition and resides at the elevated location on the mast when the jib is retracted into the vertical-mode position.

Preferably the jib, at the guide point thereon, comprises pairs of rollers lying perpendicularly one of another to constrain the singular winchline in two dimensions during movement of said winchline through the guide point.

Preferably the jib is pivotally supported on the mast for pivotal movement between the slant-mode condition and the vertical-mode position.

Preferably there is at least one actuator operable to move the jib between the slant-mode condition and the vertical-mode position.

Preferably the at least one actuator comprises at least one hydraulic linear actuator.

Preferably the jib is selectively movable into any one of a plurality of different slant-mode positions each placing the outboard point at a different respective radial distance from the mast.

According to a fifth aspect of the invention, there is provided an apparatus for guiding continuous rod into a continuous rod injector, said apparatus comprising one or more segments defining a guide path for the continuous rod to follow into the continuous rod injector, said one or more main segments including a swivel-equipped segment comprising first and second sections joined together at respective ends of said two sections by a swivel connection that enables relative rotation between said first and second sections about an axis that lies longitudinally of said first and second sections.

Preferably the first and second sections are arc-shaped sections.

Preferably the first and second sections comprise hollow tubing that has a longitudinally arc-shaped curvature and which is sized for passage of the continuous rod longitudinally through said tubing.

Preferably at least one non-swiveling segment connected between the swivel-equipped segment and the continuous rod injector.

Preferably the at least one non-swiveling segment consists of a singular first segment connected or connectable to the continuous rod injector at a proximal end of said first segment, the swivel-equipped segment being connected to the first segment via a distal end of the first segment that resides opposite the proximal end of the first segment in a longitudinal direction of said first segment.

Preferably there is at least one pivot joint providing a pivotal connection between the swivel-equipped segment and the at least one non-swiveling segment.

Preferably the swivel-equipped segment is a second segment directly coupled to the first segment by a respective pivot joint, the second segment being movable about the respective pivot joint between a stowed position reaching back toward the proximal end of the first segment, and a deployed position extending away from the proximal end of the first segment at the distal end of said first segment to form an extension of the first segment.

Preferably there is an additional swivel joint positioned to reside at a location further along the guide path from the continuous rod injector than the swivel connection of the swivel-equipped segment, said additional swivel joint carrying an extension segment in a manner enabling relative rotation between said extension segment and a neighbouring segment to which the extension segment is connected by said additional swivel about a second axis that lies longitudinally of said extension segment and said neighbouring segment.

Preferably said extension segment defines an open mouth at an end of the guide path opposite the continuous rod injector, whereby the additional swivel enables swiveling of the extension segment into and out of coplanar relationship with the neighbouring segment to aim the open mouth of the guide path in different directions.

Preferably the extension segment is assembled from a series of two or more extension sections, each being of lesser length than any of the other segments.

According to a sixth aspect of the invention, there is provided a continuous rod guide for guiding continuous rod into a continuous rod injector, said continuous rod guide comprising a plurality of segments for cooperatively defining a guide path for the continuous rod to follow into the continuous rod injector, said plurality of segments including a plurality of foldable segments among which at least one pair of adjacent segments are connected by a respective pivot joint and a respective actuator connected between the adjacent segments to effect relative movement thereof between stowed positions folded back along one another and deployed positions forming longitudinal extensions of one another.

Preferably there is at least one swivel joint installed among the segments at an intermediate location along the guide path, said swivel joint enabling swiveling movement among the segments about shared longitudinal axes thereof to enable said guide path to deviate from a singular plane and occupy a three dimensional shape.

Preferably the at least one swivel joint comprises two swivel joints.

Preferably the plurality of segments are arranged to lie in an upright orientation atop the continuous rod injector when fully folded.

Preferably there is provided a support seat at a base of the rod guide and comprising an inclined stop situated to a convex side of a first of the segments to block movement of said first of the segment past an upright position.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
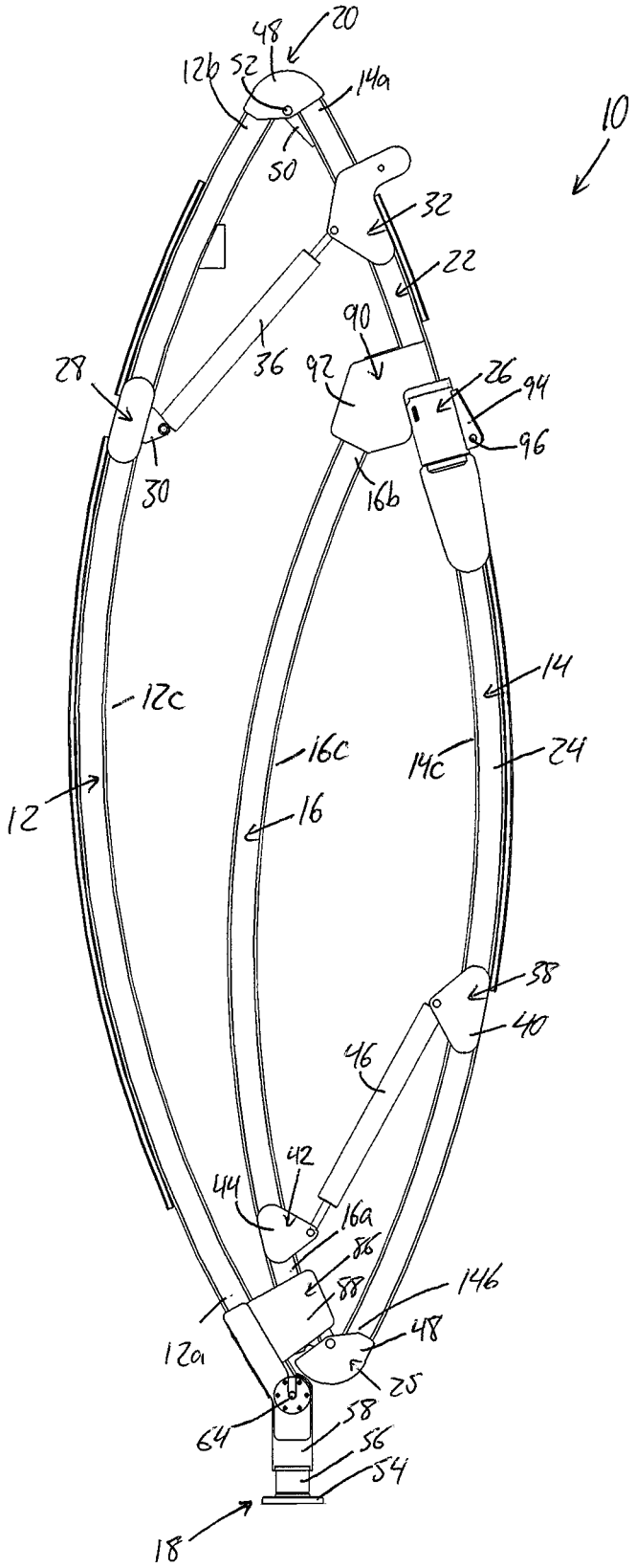
FIG. 1 is a rear elevational view of foldable main segments of a continuous rod guide in a fully folded state.

FIG. 1 illustrates a foldable main structure of a rod guide 10 for guiding continuous rod between a reel and a continuous rod injector that injects and withdraw continuous rod into and from a wellbore, for example for, but not limited to, use of the continuous rod as part of an artificial lift or pumping system for producing well fluids to the surface. The main structure 10 of the rod guide features three arc-shaped main segments 12, 14, 16 pivotally coupled to one another. Each main segment 12, 14, 16 features opposing proximal and distal ends spaced apart in a longitudinal direction in which the segment is arcuately curved. The arc-shape of each main segment shares the same radius of curvature as the other two main segments. The first 12 main segment features a base 18 attached to its proximal end 12*a*, and a first pivot joint 20 attached to its opposing distal end 12*b*. The second main segment 14 is divided into two sections 22, 24, the first of which defines the proximal end 14*a* of the second main segment, and the second of which defines the opposing distal end 14*b* thereof. The proximal end 14*a* of the second main segment is pivotally coupled to the distal end 12*b* of the first main segment 12 by the first pivot joint 20, whereby the first and second main segments 12, 14 are pivotable relative to one another about a first pivot axis that lies normal to the plane shared by the arc-shapes of the first main segment and the first section of the second main segment. In their longitudinal directions, the first and second main segments 12, 14 are approximately equal in length. The orientation of the second main segment relative to the first is such that the concave sides of the arc-shapes of the first main segment and the first section 22 of the second main segment face toward one another when the second main segment resides in a stowed position reaching back toward the proximal end 12*a* of the first segment on the concave side 12*c* thereof, as shown in FIG. 1. In this stowed position, the distal end 14*b* of the second main segment resides closely adjacent the proximal end 12*a* of the first segment 12 due to the similar lengths of these two segments 12, 14. The facing-together concave sides 12*c*, 14*c* of the first and second main segments 12, 14 delimit an eye-shaped area of generally oval or elliptical shape.

The third main segment 16 has its proximal end pivotally coupled to the distal end of the second segment by a second pivot joint 25, whereby the second and third segments 14, 16 are pivotable relative to one another about a second pivot axis that lies normal to the planes occupied by the arc-shapes of the third main segment and the second section of the second main segment. The third main segment 16 is also shorter in length than both of the first and segment main segments, and is oriented relative to the second section 24 of the second main segment 14 so as to face concavely toward the concave side 14*c* of the second section of the second main segment when the third main segment is manoeuvred into the folded position of FIG. 1 in which it reaches back toward the proximal end 14*a* of the second main segment. The second and third main segments thus also delimit an eye-shaped area of generally oval or elliptical shape between their concave sides 14*c*, 16*c* in the fully folded state of the main section 10 shown in FIG. 1, but one of lesser area than that delimited by the first and second main segments. The shorter length of the third main segment allows it to fit within the larger area delimited between the first and second main segments in the fully folded state of the main section.

In this fully folded state, the all three segments 12, 14, 16 reside in the same plane as one another. However, when the segments are unfolded, the main structure may deviate from this coplanar relationship due to the presence of a swivel joint 26 between the two sections 22, 24 of the second main segment 14, which enables relative rotation between the two sections 22, 24 on an axis lying longitudinally thereof.

Figure 2:
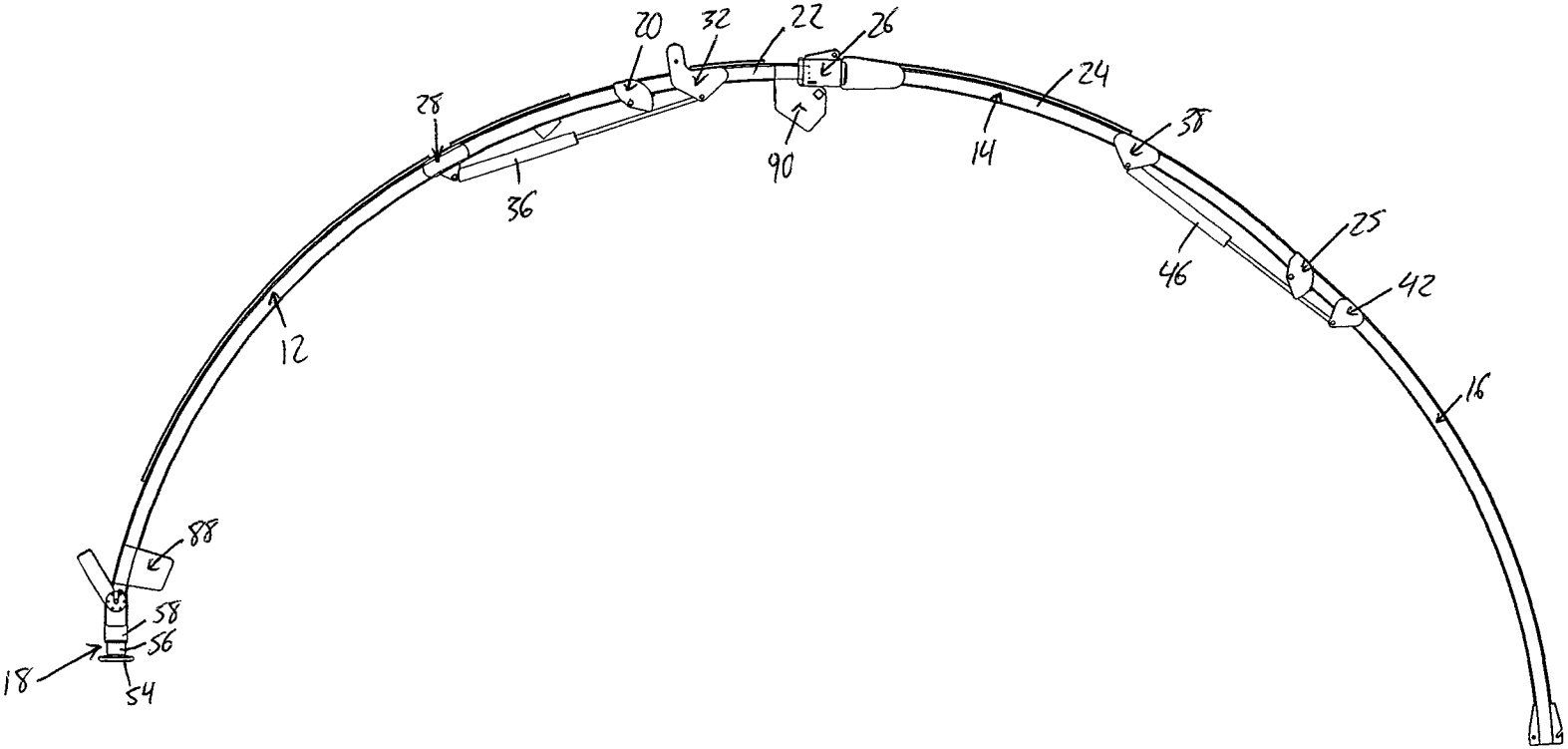
FIG. 2 is a rear elevational view of the foldable main segments of FIG. 1 in a fully unfolded state.
Figure 3:
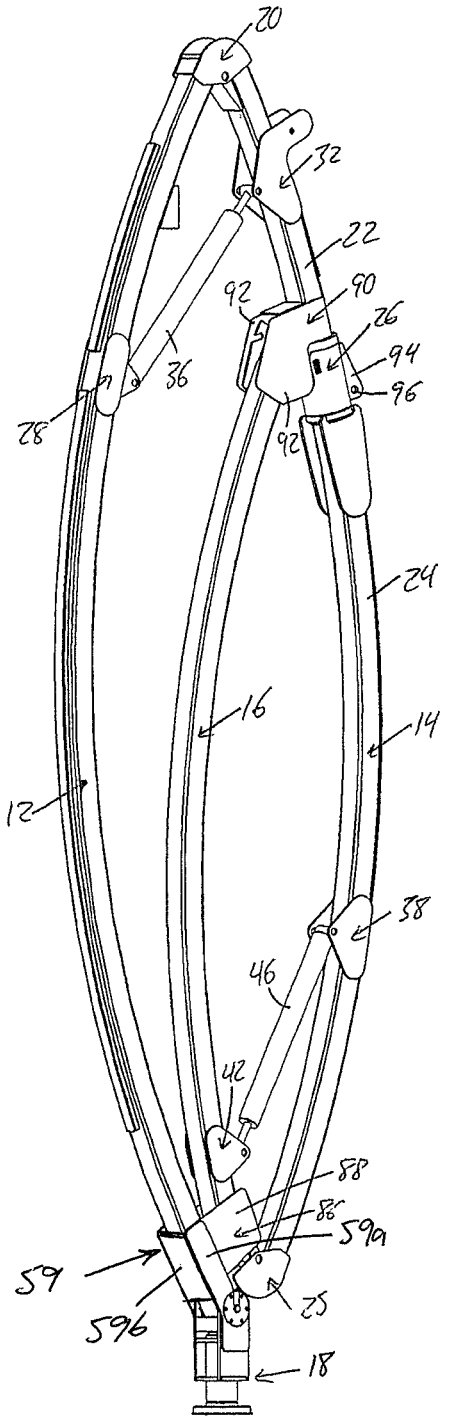
FIG. 3 is a rear perspective view of the foldable rod guide segments of FIG. 1 from one side thereof.
Figure 4:
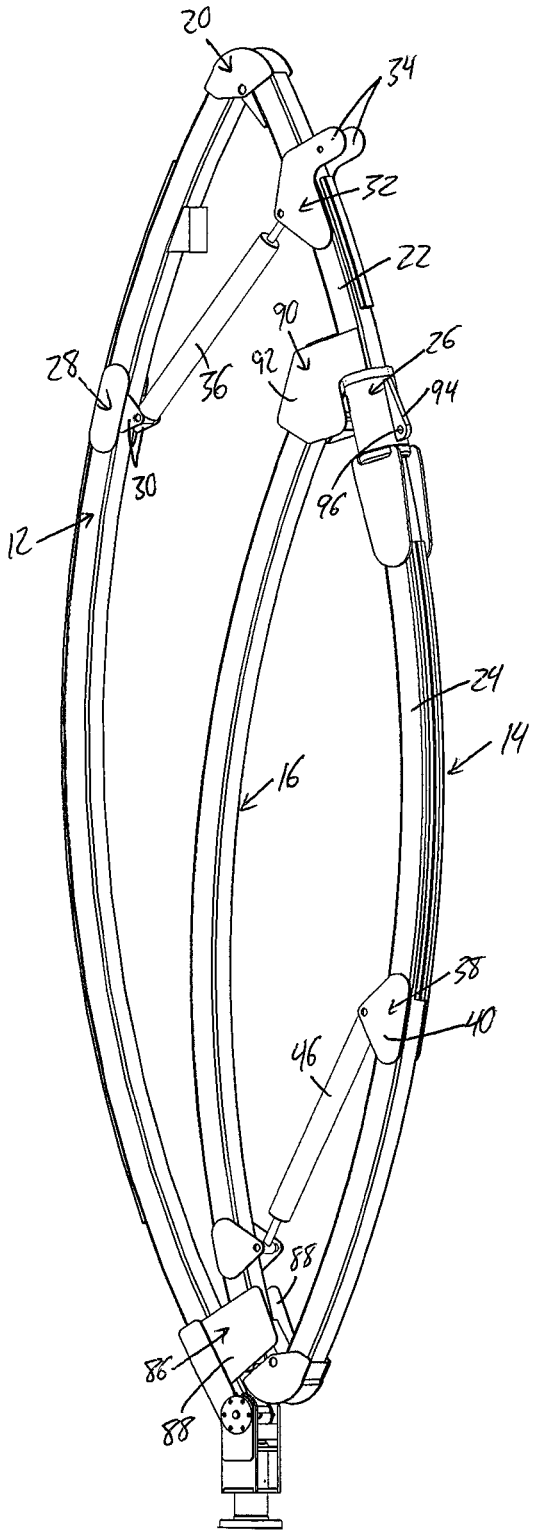
FIG. 4 is a rear perspective view of the foldable rod guide segments of FIG. 1 from another side thereof.
Figure 5:
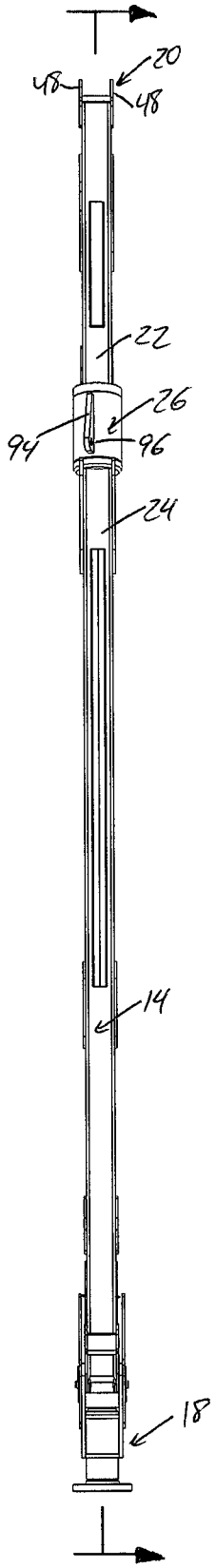
FIG. 5 is a side elevational view of the foldable rod guide segments of FIG. 1.
Figure 6:
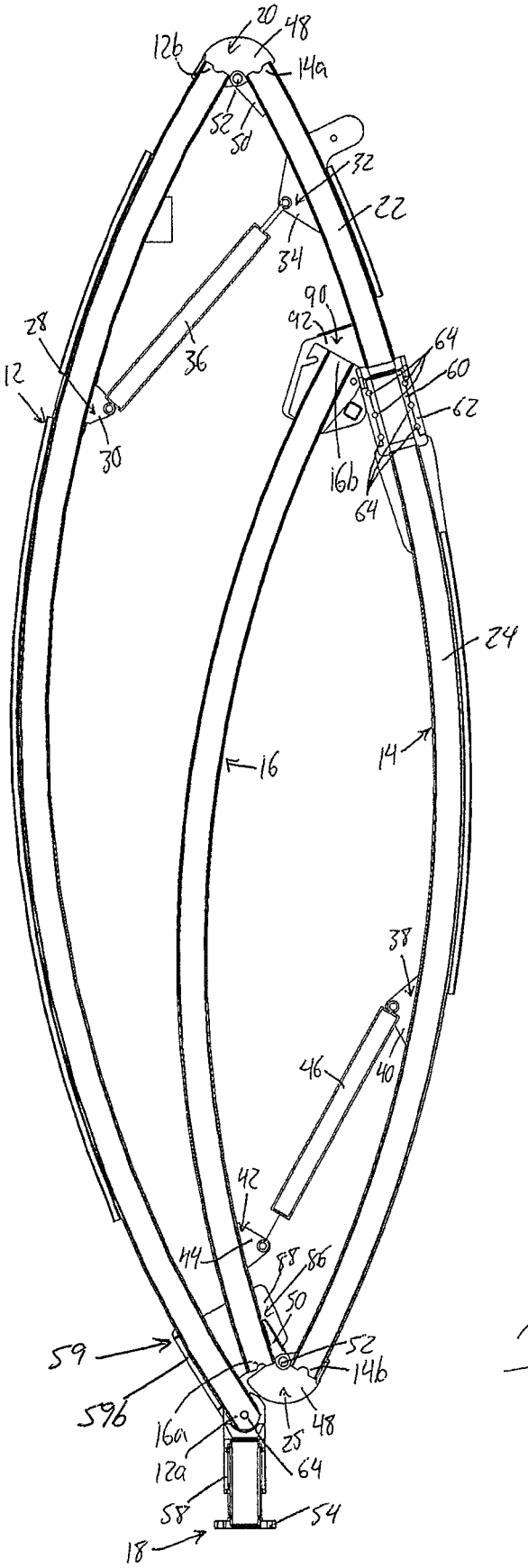
FIG. 6 is a cross-sectional view of the foldable rod guide segments of FIG. 5 as viewed along line A-A thereof.

Summed together, the individual arc lengths of the three main segments total approximately 180-degrees, as can be seen in the fully unfolded state of the main structure shown in FIG. 2, where the second main segment (with both sections thereof coplanar with one another, and thus also coplanar with the first main segment) extends away from the proximal end of the first main segment at the distal end thereof in a deployed position to form a generally continuous extension of the first main segment along the same arcuate path, and the third main segment likewise extends away from the proximal end of the second segment at the distal end thereof in an unfolded position to form a generally continuous extension of the second main segment along the same arcuate path. With the third main segment 16 being shorter than the other two main segments, and with the swivel joint 26 being located nearer to the proximal end of the second main segment 14 than the distal end thereof, the swivel joint 26 resides at an approximate midway point along the total arc-shaped length of the fully unfolded rod structure 10.

Each main segment 12, 14, 16 features hollow tubing of rigid shape and arcuate curvature in its longitudinal dimension, for example attained by bending of initially-linear rectangular metal tubing into this curved shape. The cross-sectional size of the tubing is sufficient to accommodate passage of standard cross-sectional sizes of continuous rod therethrough. While the illustrated embodiment is described as employing rectangular tubing, including square tubing, other embodiments may use tubing of round or other cross-sectional shape. The first and third main segments of the illustrated embodiment each have only a singular length of continuous tubing defining the full length of the segment, while the swivel-equipped second main segment features two discrete lengths of tubing, one defining each of its two sections 22, 24, which are joined together by the swivel joint 26.

At an intermediate point nearer to its distal end 12*b* than its proximal end 12*a*, the first main segment 12 features a first cylinder mount 28 having two side plates 30 affixed to opposing flat side walls of the rectangular tubing. Similarly, a second cylinder mount 32 is defined by another pair of side plates 34 affixed to opposite sides of the first section 22 of the second main segment at a location nearer to the proximal end 14*a* of the second main segment than the distal end 14*b* thereof. A first hydraulic linear actuator 36 has one end pinned to the first cylinder mount 28, and its opposing end pinned to the second cylinder mount 32, whereby collapse of the first hydraulic linear actuator 36 pulls the second main segment 14 into its stowed position, while extension of the first hydraulic cylinder 36 forces the second main segment 14 into its deployed position. The first hydraulic linear actuator 36 is thus operable to effect relative movement between the first and second main segments 12, 14 about the pivot axis of the first pivot joint 20.

At an intermediate point nearer to its distal end 14*b* than its proximal end 14*a*, the second main segment 14 features a third cylinder mount 38 having two side plates 40 affixed to opposing flat side walls of the segment's second section 24 of hollow tubing. Similarly, a fourth cylinder mount 42 is defined by another pair of side plates 44 affixed to opposite sides of the third main segment 16 at a location nearer to the proximal end 16*a* thereof than to the distal end 16*b* thereof. A second hydraulic linear actuator 46 has one end pinned to the third cylinder mount 38, and its opposing other end pinned to the fourth cylinder mount 42, whereby collapse of the second hydraulic linear actuator 46 pulls the third main segment 16 into its folded position, while extension of the second hydraulic linear actuator 46 forces the third main segment 16 into its unfolded position reaching away from the distal end of the second main segment 14. The second hydraulic cylinder 46 is thus operable to effect relative movement between the second and third main segments about the pivot axis of the second pivot joint 25.

Each pivot joint 20, 25 features a respective pair of side plates 48 affixed to the flat opposing side walls of one of the two pieces of rectangular tubing it connects together, and a pivot block 50 affixed to the bottom wall of the other piece of the rectangular tubing on the concave side thereof. The pivot block 50 and the side plates 48 each reach past the end of the respective piece of tubing, where the pivot block 50 reaches into the space between the side plates 48 and is pinned thereto by a pivot pin 52 crossing perpendicularly through the side plates 48. The pivot pin thus defines a pivot axis that is perpendicular to plane occupied by the arc-shaped curvature of the two pivotally connected tubes.

The base 18 at the proximal end 12*a* of the first main segment 12 features a mounting flange 54 with a circumferential array of bolt holes therein for bolting the rod guide to the frame of a continuous rod injector at the upper end thereof. Affixed to and standing axially upward from the mounting flange on a longitudinal axis of the base is a hollow cylindrical member 56 that reaches upwardly into an outer housing 58 of the base. The proximal end 12*a* of the first segment 12 is pivotally coupled to the outer housing 58 of the base by a pivot pin 64 that crosses therethrough in a direction perpendicular to the longitudinal axes of the base 18 and the first main segment. The outer housing 58 is rotatable around the hollow cylindrical member 56, for example by way of bearings disposed therebetween. With the hollow member 56 of the base 18 attached to the frame of the injector by the mounting flange 54, and with the outer housing 58 of the base connected to the first main segment 12 by the pivot pin 64, the rotational action between the base 18 allows swiveling of the entire rod guide 10 about the longitudinal axis of the base.

A support seat 59 is affixed to the outer housing 58 of the swivel-enabling base 18, and features two side plates 59*a* that resides in vertical planes and slope upward from the outer housing 58 at an inclined angle so as to extend partially along the first main segment from the proximal end thereof when the foldable main structure is in its fully folded state of FIGS. 1 and 3 to 6. A stop plate 59*b* of the support seat 59 spans between the two side plates 59*a* in an inclined plane that is perpendicular to the vertical planes of the side plates 59*a*. The stop plate 56*b* resides on the convex side of the first main segment 12 to provide a stop against which the convex side of the first main segment rests in the fully folded state of the main structure. In the fully folded state of the main structure, the angle of the stop plate 59*b* matches a tangential direction of the first main segment's arc-shape near the proximal end of the first segment.

In this fully folded state of the main structure, the first main segment stands upright from the base 18 so that the distal end 12*b* of the first main segment is in vertical alignment, or near-alignment, over the proximal end 12*a* of the first main segment 12. The pivot pin 52 of the first pivot joint 20 at the distal end of the first segment therefore lies in, or closely adjacent to, a same vertical plane as the pivot pin 64 that pivotally connects the proximal end 12*a* of the first main segment 12 to the outer housing 58 of the base 18.

Likewise, in the fully folded state of the foldable main structure, the second main segment 14 resides in an upright position generally mirroring that of the first main segment 12 across the vertical plane shared, or closely neighboured, by pivot pins 52, 64, except that the distal end 14*b* of the second segment 14 is slightly offset from this vertical plane due to the slightly lesser length of the second main segment 14 compared to the first main segment 12. The second main segment 14 thus hangs downwardly from the first pivot joint 20 at the distal end of the first main segment 12 in the fully folded state of the foldable main structure 10. The generally elliptical shape delimited between the first and second main segments 12, 14 therefore occupies an upright orientation placing its longer primary axis in a vertical or near-vertical orientation when the main section is fully folded. Finally, the third main segment 16 stands in generally upright relation above the base 18, reaching upwardly from the second pivot joint 25 inside the generally elliptical eye-shaped area delimited between the first and second main segments in the fully folded state of the main section. In these upright positions or orientations of the fully folded segments, the arching longitudinal axis of each segment is more vertically oriented than it is horizontally orientated. That is, at any given location along any segment, the slope of the segments arc-shaped longitudinal axis is closer to vertical than it is to horizontal.

Standing upright atop the injector, the fully-folded main section occupies a minimal width so that none of the long segments are cantilevered out from the injector and introduce an imbalance to the injector. The entire main section can reside entirely, or substantially entirely, within the shadow of a mast 100 to which the injector is mounted in a finished rig, as described below with reference to the subsequent figures, thus again contributing to a compact, well-balanced design. The stop plate 59*b* of the support seat 59 prevents the first segment from tilting past its upright position in the fully folded state of the main section, thus helping positively position the main section in the upright orientation when fully folding up same between uses of the rod guide to enable compact storage and transport of the rig. With the main section fully folded, and the first main segment resting on the stop plate of the seat, a further securement of the fully folded main section to the mast is performed, for example using a hydraulically operated clamping mechanism (not shown) mounted further up on the mast near the first pivot joint 20 situated at the upper end of the folded up main structure. It will be appreciated that the The swivel joint 26 in the second main segment 14 features a hollow cylindrical race 60 having a plurality of circumferential grooves defined in the exterior thereof at axially spaced positions therealong, and a hollow cylindrical outer housing 62 that closes concentrically around the race 60 and features a set of matching circumferential grooves in the interior thereof to align with the exterior circumferential grooves of the inner race 60. A set of spherical balls 65 or other roller elements reside in the aligned grooves of the inner race and outer housing to enable rotation therebetween about a longitudinal axis shared by the race and outer housing. Opposite ends of the inner race 60 and outer housing 62 are attached to the first and second sections 22, 24 of the second main segment 14, and the shared longitudinal axis of the joint's inner race and outer housing is in general alignment with the longitudinal axes of the two tubular sections 22, 24 of the second main segment. Accordingly, the two sections 22, 24 can swivel or rotate relative to one another about this longitudinal axis of the joint 26.

A first stabilizing bracket 86 is mounted on the first main segment 12 near the proximal end 12*a* thereof, and features a pair of side plates 88 fixed to the opposing sides walls of the first segment's tubular body in positions extending outward from the concave side of the first segment. A proximal portion of the tubular body of the third main segment 16 is received between the side plates of the stabilization bracket 86 in the fully folded state of the rod guide's main structure 10, thereby blocking deflection of the proximal end of the third main segment and the connected distal end of the second main segment out of coplanar alignment with the first main segment. Likewise, a second stabilizing bracket 90 is mounted on the first section 22 of the second main segment 14 near the proximal end 14*a* thereof, and features a pair of side plates fixed to the opposing side walls of the first tubular section 22 of the second main segment in positions extending outward from the concave side of the second main segment. A distal portion of the tubular body of the third main segment 16 is received between the side plates of the second stabilization bracket 90 in the fully folded state of the rod guide's main structure 10, thereby blocking deflection of the distal end of the third main segment out of the coplanar alignment with the first and second main segments in the fully folded state of the rod guide.

The outer housing 62 of the swivel joint 26 in the second segment 14 features a lug 94 projecting radially outward therefrom on the convex side of the second segment 14. A through-hole 96 in the lug 94 forms a tether point for connection of a winchline thereto during use of the rod guide on a continuous rod injector of a well servicing rig, as described herein in further detail below.

Figure 7:
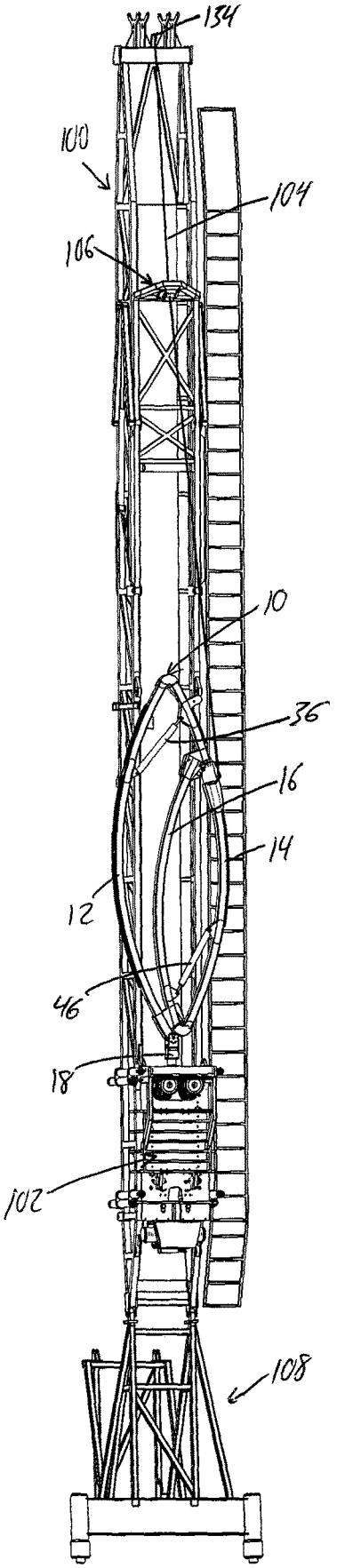
FIG. 7 is a rear perspective view of a mast of a well servicing rig featuring the foldable rod guide segments of FIG. 1 and a cooperating jib, the mast being shown in an upright orientation for a vertical well application and the rod guide and jib being shown in fully folded and retracted states, respectively.

Having described the structure of the foldable rod guide's foldable main structure 10 with reference to FIGS. 1 to 6, attention is now turned to FIG. 7, which shows the main structure in an installed position as part of a well servicing rig. The base 18 of the main structure 10 is installed atop a continuous rod injector 102 that is supported in an installed position on an upright mast 100 of the well servicing rig, which may for example be a mobile well servicing rig featuring a wheeled self-propelled vehicle on which the mast is installed in a movable manner pivotal about a horizontal axis between a stowed position lying generally horizontally in a longitudinal direction of the vehicle and a working position standing upright from the vehicle in a vertical or inclined orientation. Such mobile rigs are well known in the art, and thus not described herein in further detail, with the exception of unique features and functions of the mast 100 and the rod guide installed on the injector, as outlined herein below in further detail. However, it will be appreciated that the present invention also be employed on stationary rigs.

FIG. 7 shows the mast 100 in a vertically upright state so that a rod-conveyance path of the injector 102 supported on the mast at a rear side thereof is likewise vertically oriented in order to inject continuous rod into a vertical well bore near which the vehicle is parked to place the lower end of the rod-injector in alignment over the well bore, as is well known in the art. The rear side of the mast is used here to denote that side that faces rearwardly from the vehicle in a longitudinal direction thereof. The mast carries a jib 106 at a location spaced upward from the injector, and a winchline 104 extends downwardly from the jib 106 to the tether point 94 on the second main segment 14 of the rod guide 10. In FIG. 7, the rod guide's main structure 10 is shown in its fully folded state with the swiveling base 18 set in an angular position that places the folded-up main segments 12, 14, 16 of the rod guide in a vertical plane lying perpendicularly cross-wise to the longitudinal direction of the rig vehicle. To prepare the injector for use, the rod guide's main structure 10 is unfolded in order to arc outwardly away from the mast 100 toward a reel of continuous rod situated to one side of the rig vehicle for feeding of continuous rod off the reel and into the injector through the hollow tubing of the rod guide for injection of the continuous rod into the well, or withdrawal of continuous rod from the well back to the reel. During either process, in traversing the unfolded main structure 10, the continuous rod transitions between the two sections of the second main segment through the hollow inner race of the swivel joint 26, and transitions between the injector and the rod guide through the hollow inner member of the base 18.

Figure 8:
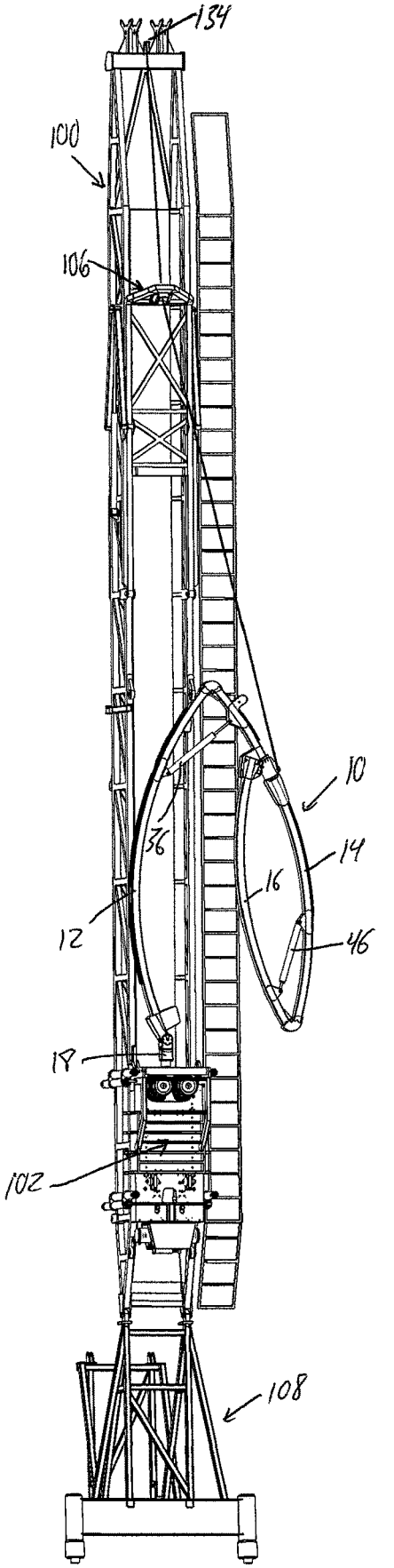
FIG. 8 is a rear perspective view of the mast of FIG. 7 during initial unfolding of the foldable rod guide segments.
Figure 9:
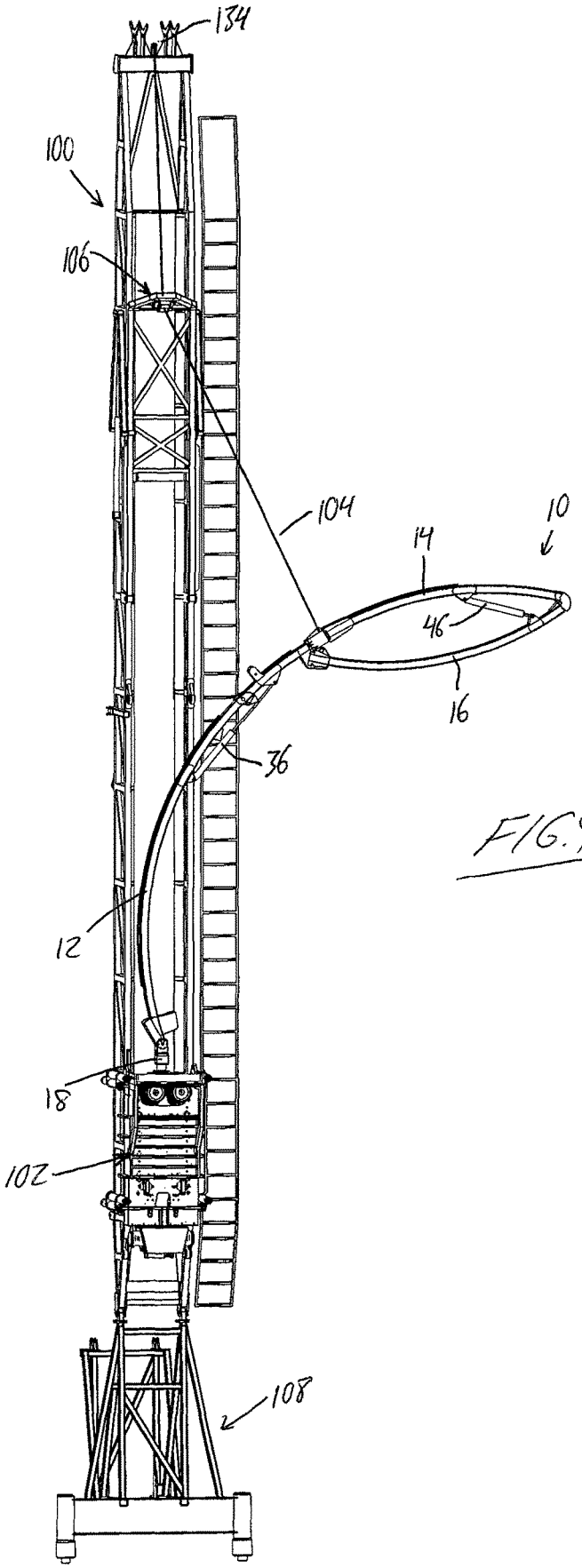
FIG. 9 is a rear perspective view of the mast of FIG. 8 during continued unfolding of the foldable rod guide segments.

FIG. 8 shows the main structure of FIG. 7 during a first stage of unfolding, during which the second hydraulic linear actuator 46 is maintained in its initial collapsed state while the first hydraulic linear actuator 36 is extended from its initial collapsed state in order to force the second main segment 14 out of its stowed position and away from the concave side of the first segment 12. During its deployment, the second main segment 14 carries the proximal end 16*a* of the folded-up third main segment outwardly away from the concave side of the first segment 12. Turning to FIG. 9, once the second segment 14 has been fully unfolded into its deployed position, it resides in-line with the first main segment 12 at the distal end 12*b* thereof, thereby completing the first unfolding stage.

Figure 10A:
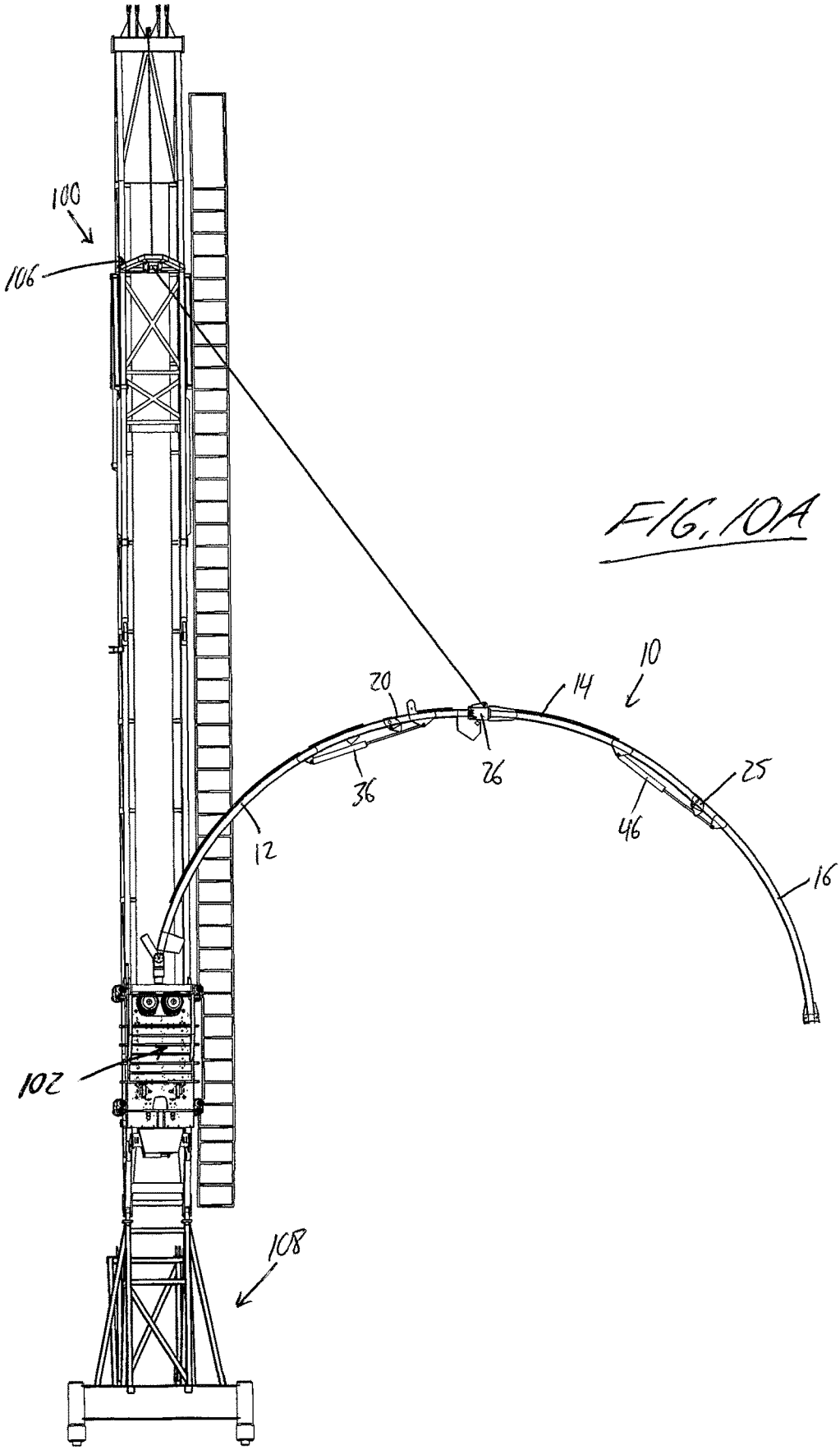
FIG. 10A is a rear elevation view of the mast of FIG. 9 with the rod guide segments fully unfolded.

Turning to FIG. 10A, the unfolding of the three main segments continues with performance of a second unfolding stage, during which the second hydraulic linear actuator 46 is extended from its initial collapsed state in order to force the third main segment 16 out of its folded position and away from the concave side of the second main segment 14, as is now allowed by sufficient spacing of the third main segment's proximal end from the first main segment due to the already-completed deployment of the second main segment.

Figure 10B:
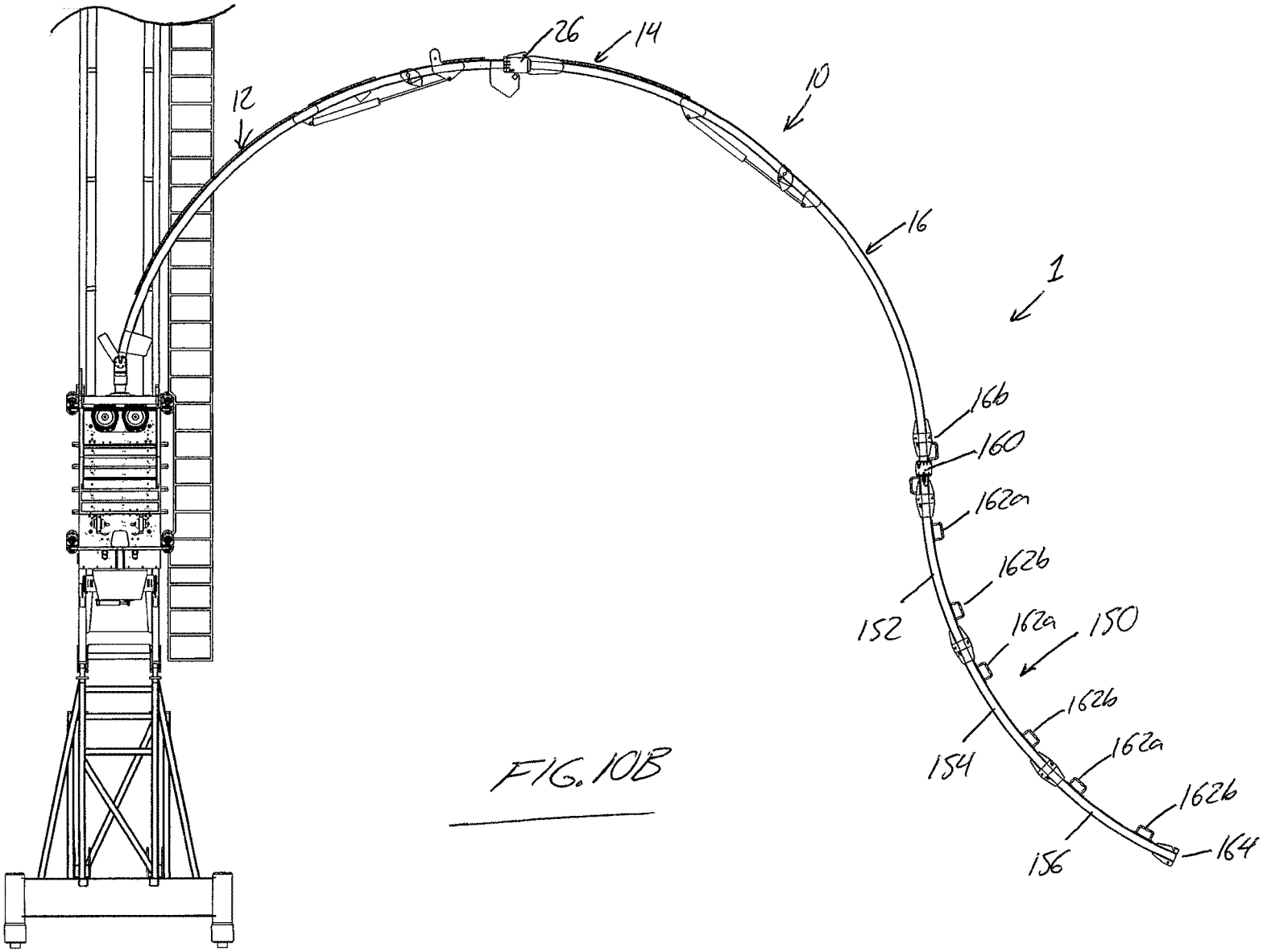
FIG. 10B is a rear elevation view of the mast of FIG. 10 with additional extension segments added to the unfolded rod guide segments to form a fully assembled rod guide.

FIG. 10B shows the rod guide 1 in a fully assembled state with the three main segments 12, 14, 16 of the foldable main structure 10 fully unfolded, and with a selectively attachable/detachable extension segment 150 coupled to the distal end 16*b* of the third main segment 16. The extension segment 150 is made up of three arc-shaped extension sections 152, 154, 156 of the same general arcuately curved tubing construction as the main segments. The three extension sections share the same length and radius of curvature as one another, but are each of lesser length than any of the main segments. An additional swivel joint 160 is detachably connected to the distal end 16*b* of the third main segment, and couples same to the proximal end 150*a* of the extension segment, thereby enabling swiveling of the extension segment around the longitudinal axis shared by the third main segment 16 and the extension segment 150 at the location of the additional swivel joint 160. The additional swivel joint 160 may be of the same construction as the first swivel joint 26 in the second main segment of the rod guide's main foldable structure. Relative movement between the extension segment 150 and the neighbouring third main segment 16 is limited purely to swiveling motion about the longitudinal axis shared by the coupled-together ends of these segments at the additional swivel joint, whereby the extension segment 150 is not foldable relative to the foldable main structure.

The extension sections are detachably coupled to the main segments by the additional swivel joint 160, as there is insufficient space to accommodate the extension section in the fully folded state of the main segments. Accordingly, once the main segments are unfolded, the extension segment is added to the unfolded main segments for example one extension section at a time. The breakdown of the extension segment 150 into smaller sections 152, 154, 156 makes for easier handling during installation and removal thereof to and from the main segments, and for space efficient transport of the extension segment 150 on the mobile rig in separate pieces. As shown, each extension section 152, 154, 156 may feature one or more carry handles, for example two carry handles 162*a*, 162*b* situated respectfully adjacent the proximal and distal ends of the extension section, for example projecting from the concave side of the section.

By way of the additional swivel joint 160, the arc-shaped extension segment 150 can rotate about the longitudinal axis of the additional swivel joint 160 and thus swivel into and out of coplanar alignment with the neighbouring third main segment 16. An open mouth 164 at the distal end 150*b* of the extension segment is where the continuous rod transitions into the rod guide from a storage reel (not shown). The swiveling support of the extension segment 150 on the foldable main sections of the rod guide enables the mouth 164 to be aimed in different directions relative to the plane of the neighbouring third main section. This enables better and easier alignment of the mouth 164 of the rod guide 1 with a tangential direction of the storage reel for smooth motion of the continuous rod to and from the reel. By way of the two swivel joints 26, 160, the overall rod guide formed by the foldable main segments and the selectively attachable extension segment can therefore deviate from a singular plane to create a three dimensional guide path occupying up to three different planes. This way, the geometry of the overall path of the rod guide can adopt an optimal three-dimensional shape for the continuous rod to follow between the storage reel and the injector.

Figure 11:
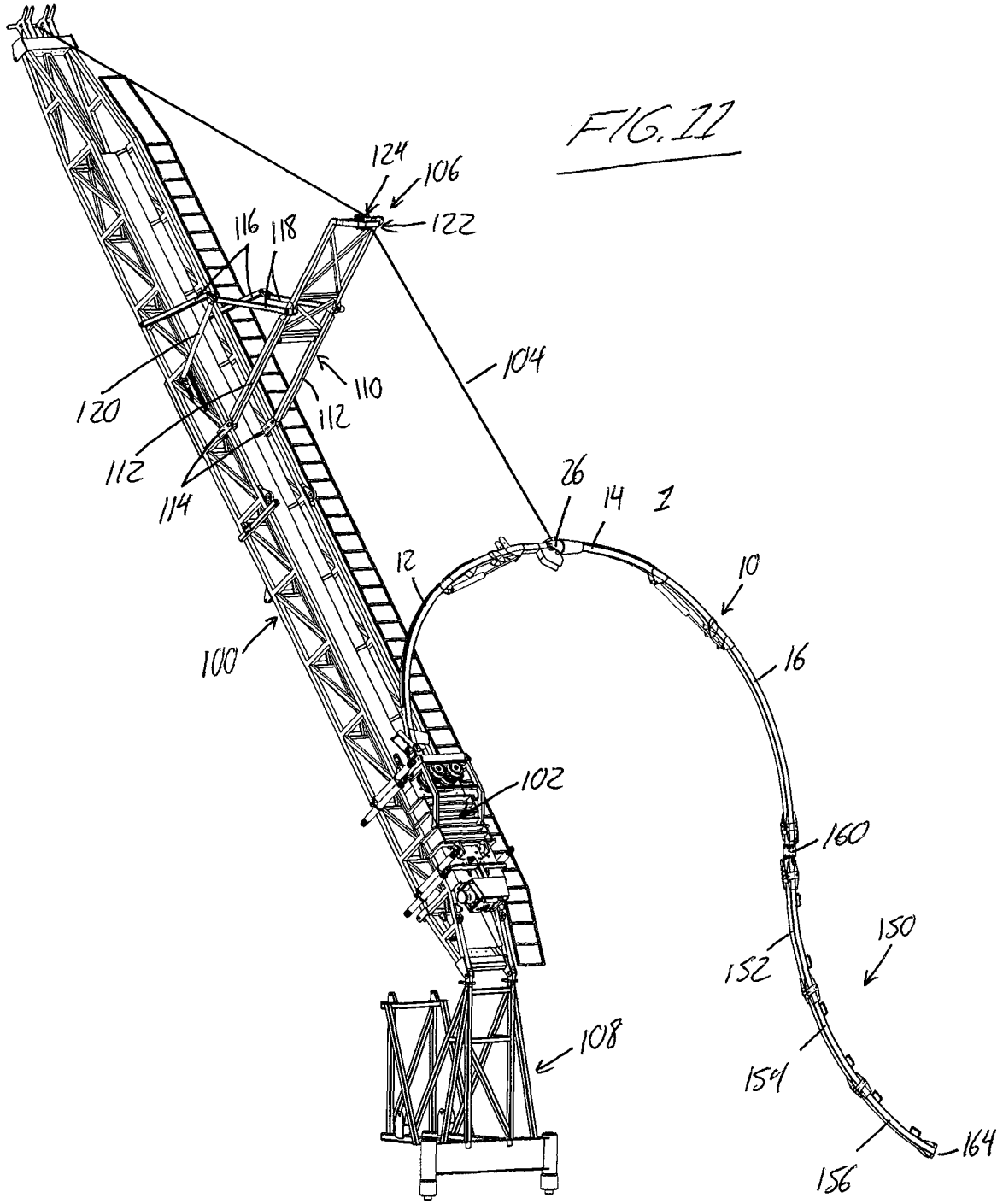
FIG. 11 is a rear perspective view of the mast of FIG. 7 in an inclined orientation for a slant well application, and with the foldable rod guide segments and jib being shown in fully unfolded and deployed states, respectively.
Figure 12:
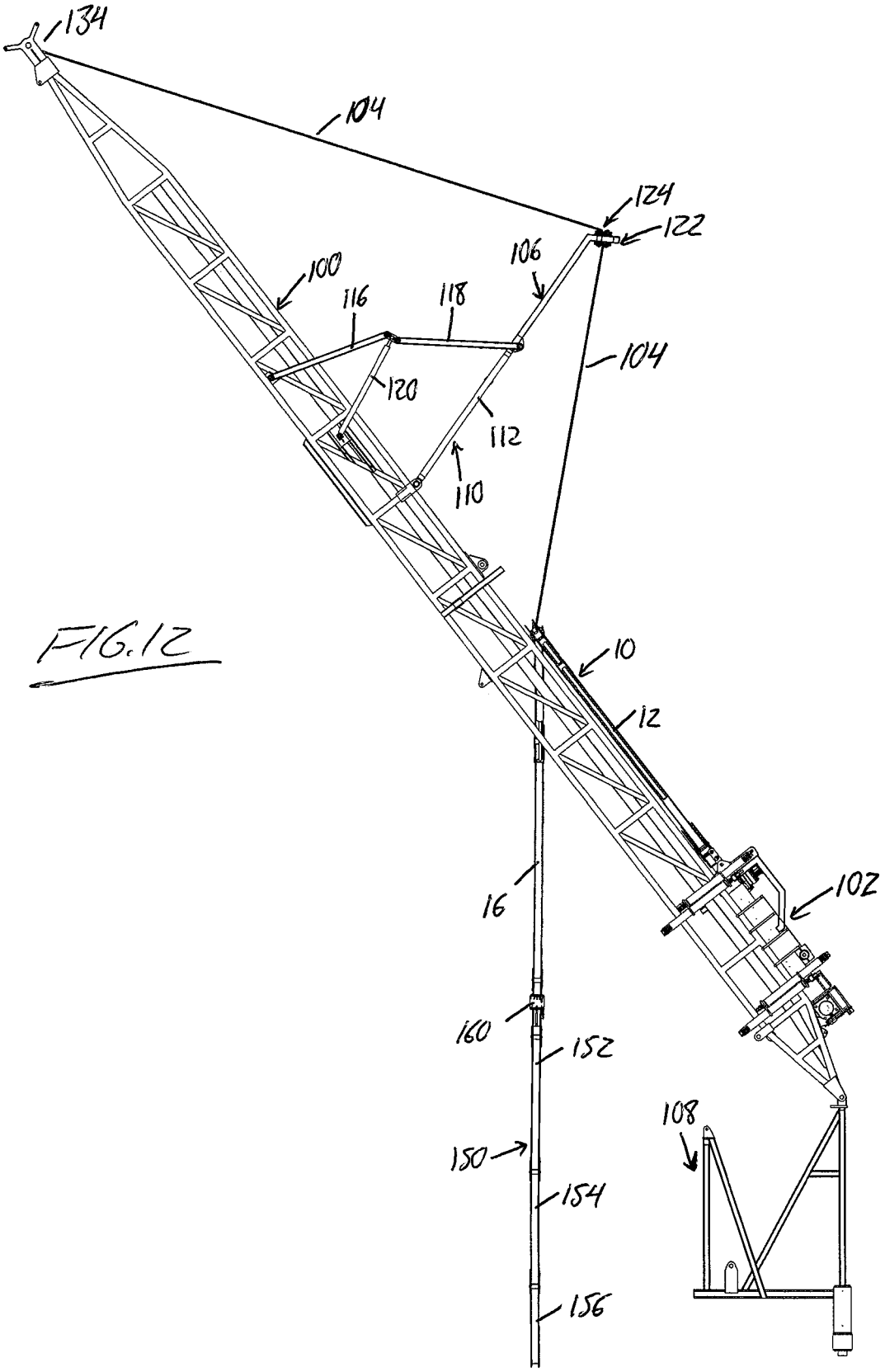
FIG. 12 is a side elevational view of the mast of FIG. 11.

FIG. 11 shows the fully unfolded and assembled rod guide 1 on the same mast-supported injector 102 as FIGS. 7 to 10, but with the mast in an inclined orientation sloping upwardly and forwardly relative to the longitudinal direction of the rig vehicle. Differentiation between the inclined mast orientation of FIGS. 11 and 12 from the vertical mast orientation of FIGS. 7 to 10 can be ascertained from the slope of the mast 100 relative to the underlying support framework 108 that is affixed to the rear end of a flatbed of the rig vehicle in a vertically upright position. FIGS. 7 to 10 show the mast 100 in general alignment with the vertically upright framework 108, while FIGS. 11 and 12 show a notable incline of the mast 100 relative to the framework 108. The angle of inclination of the mast is adjusted to match the angle of a particular slant well on which the injector 102 is to be used so that the rod-conveyance path of the injector aligns with the slant well. As in the vertical well application illustrated in FIGS. 7 to 10, the rod guide 10 is supported from above by a winchline 104, but in the case of the slant well application, the winchline is routed to the rod guide 10 from an outboard location situated radially outward from the mast 100 due to a deployed position of the movable jib 106 on the mast 100. As a result, the winchline 104 approaches the tether point 96 on the rod guide 10 from a position more directly overhead of the rod guide than if the winchline were routed directly from the mast 100 itself. This way, the winchline is more capable of bearing the weight of the rod guide and maintaining a stationary state of the unfolded main structure 10 in its optimal position for routing the continuous rod from the reel to the injector (and vice versa under operation of the injector in a reverse direction to withdraw the continuous rod from wellbore and spool the withdrawn rod back onto the reel for storage or transport). The better the weight-relief and positional stability provided to the rod guide by the winchline, the easier the rod guide can be set to a suitable position by a human operator manipulating one end of a guideline at ground level with the other end of the guideline coupled somewhere to the rod guide 10 above, for example near the second pivot joint 25.

Figure 13:
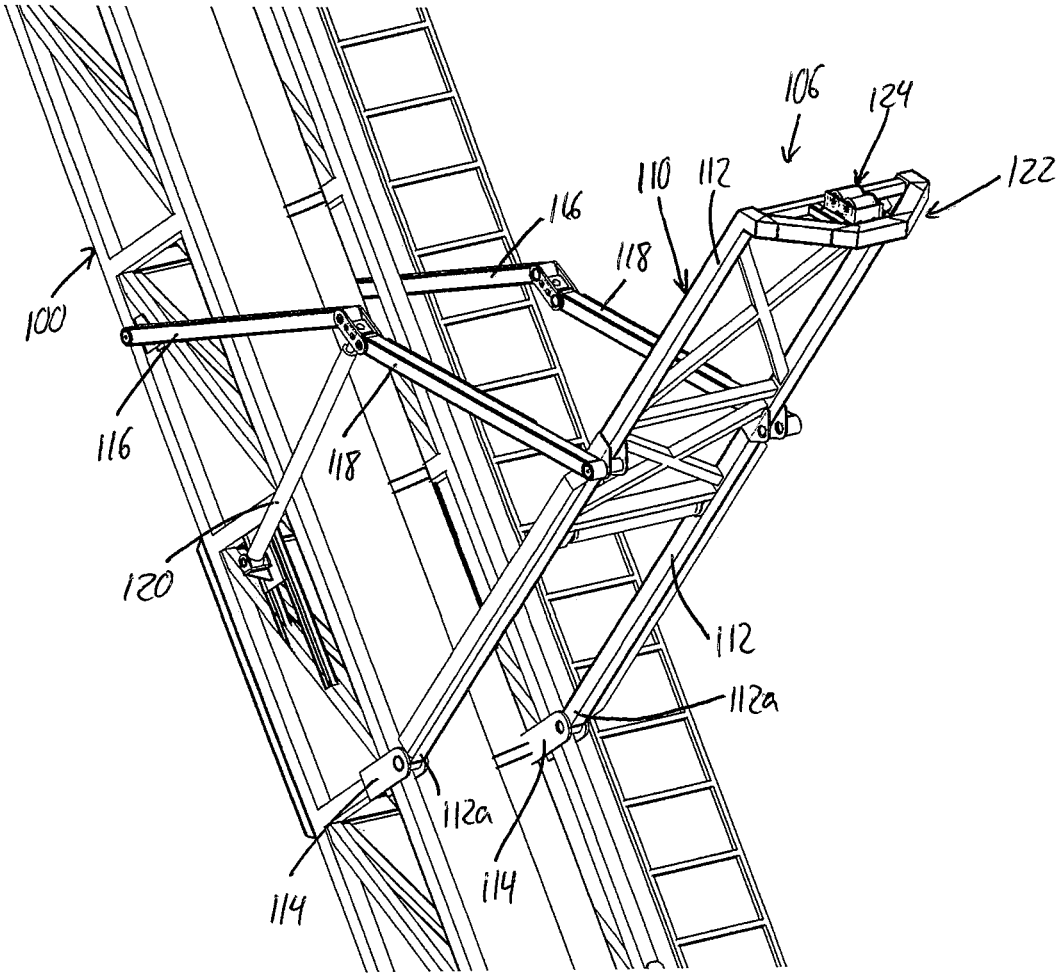
FIG. 13 is a partial closeup view of the deployed jib of the mast of FIGS. 11 to 14
Figure 14:
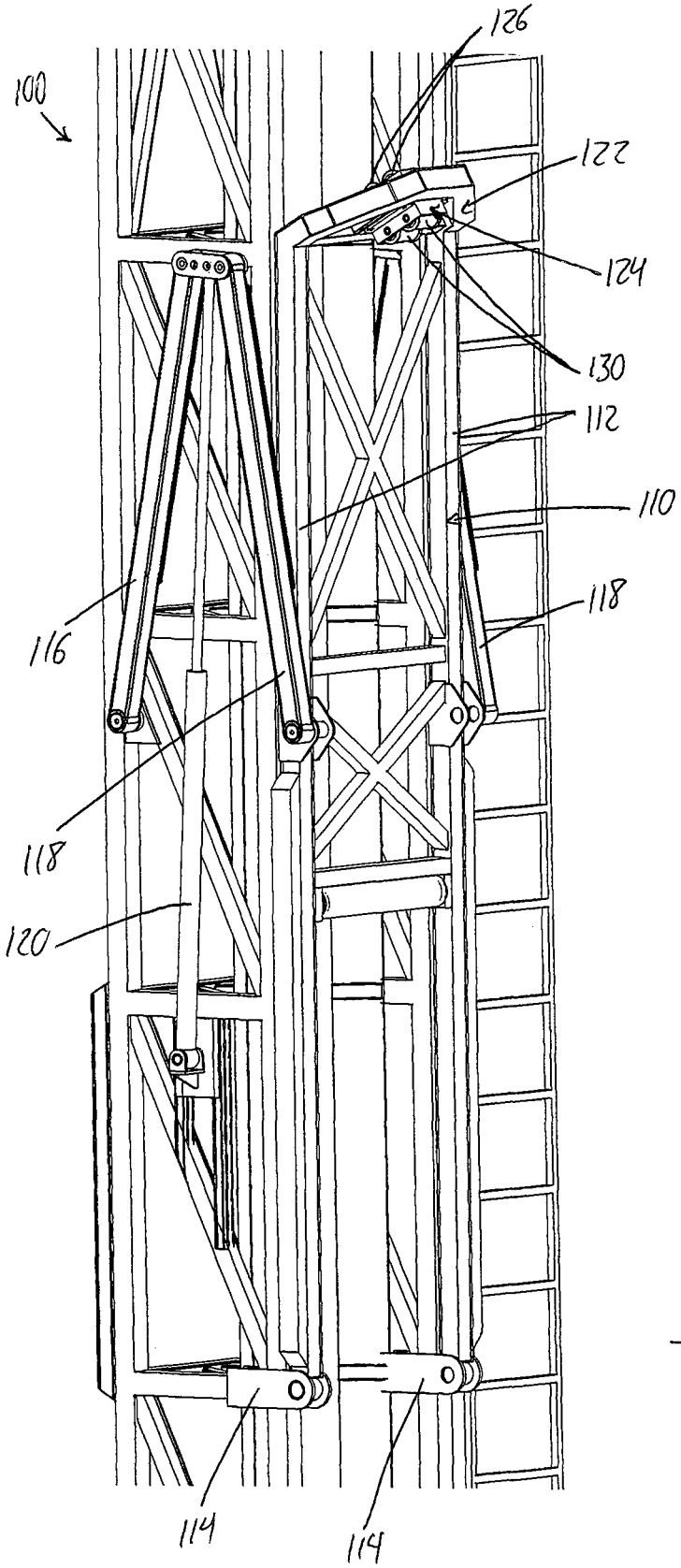
FIG. 14 is a partial closeup view of the retracted jib of the mast of FIGS. 7 to 10.

The jib 106 of the illustrated embodiment features a rectangular frame 110 having a pair of longitudinal members 112 extending a length dimension of the frame and spaced apart in a shorter width dimension of the frame. Each longitudinal frame member 112 has its lower end pinned to a respective lug 114 that projects rearwardly outward from the rear side of the mast 100. These pinned connections of the frame 110 to the mast 100 are aligned with one another to share a common horizontal pivot axis about which the jib 106 is pivotal relative to the mast 100 between a vertical-mode position (FIGS. 7-10 & 14) retracted into parallel and compact relation with the mast at the rear side thereof, and a slant-mode condition (FIGS. 11-13) reaching rearwardly outward from the rear side of the mast. Movement of the jib 106 relative to the mast 100 is constrained by two linkages, each connected between the mast and a respective one of the jib's longitudinal frame members 112 at a respective lateral side of the mast 100. Each linkage features a first link 116 horizontally pinned to the lateral side of the mast 100 at a distance upward from the lug 114 that carries the lower end of the respective longitudinal frame member 112, and a second link 118 horizontally pinned to the respective longitudinal frame member 112 at intermediate point along its length. The two links 116, 118 are horizontally pinned together to create a pivotal joint between the two links. One of the linkages features a respective hydraulic linear actuator 120 having one end horizontally pinned to both the links at the pivotal joint therebetween, and an opposing end horizontally pinned to the same side of the mast as the first link. The actuator 120 is pinned to the mast 100 at an intermediate elevation between the mast's pinned connection to the first link 116 and the mast's pinned connection to the longitudinal frame member 112 of the jib. Extension of the hydraulic linear actuator 120 retracts the jib toward the mast into the collapsed vertical-mode position, while collapse of the hydraulic linear actuator pivots the jib away from the mast into the slant mode condition.

At a distal end of the rectangular frame 110 of the jib 106, i.e. the end thereof opposite the pinned connection to the rearwardly jutting lugs 114 of the mast, a smaller sub-frame 122 is affixed to the rectangular frame 110 and lies in a different plane oriented obliquely thereto so that, as best shown in FIG. 12, when the jib is deployed to extend rearwardly and upwardly from the rear side of the inclined mast, the sub-frame 122 resides in a more horizontal orientation than the main rectangular frame 110 of the jib 106. A guide unit 122 for the winchline 104 is mounted to the sub-frame 122 of the jib 106 and features a rectangular housing with four side walls and open top and bottom ends, whereby the winchline can be routed downwardly through the guide unit 124 and the subframe 122 toward the rod guide 10 from a routing or origin point 134 situated higher up on the mast near the top end thereof. This routing or origin point 134 may feature the winch itself, or a pulley or other guide for routing the winchline over this point from a winch mounted elsewhere on the mast. That is, the winch from which the winchline originates may reside proximate the top end of the mast with the winchline thus extending straight from the winch to the guide unit 124 of the jib 106, or the winch may be mounted elsewhere on the mast or rig, with the winchline routed over a pulley or other guide near the top of the mast, and down to the jib 106 from this elevated routing point.

Figure 15:
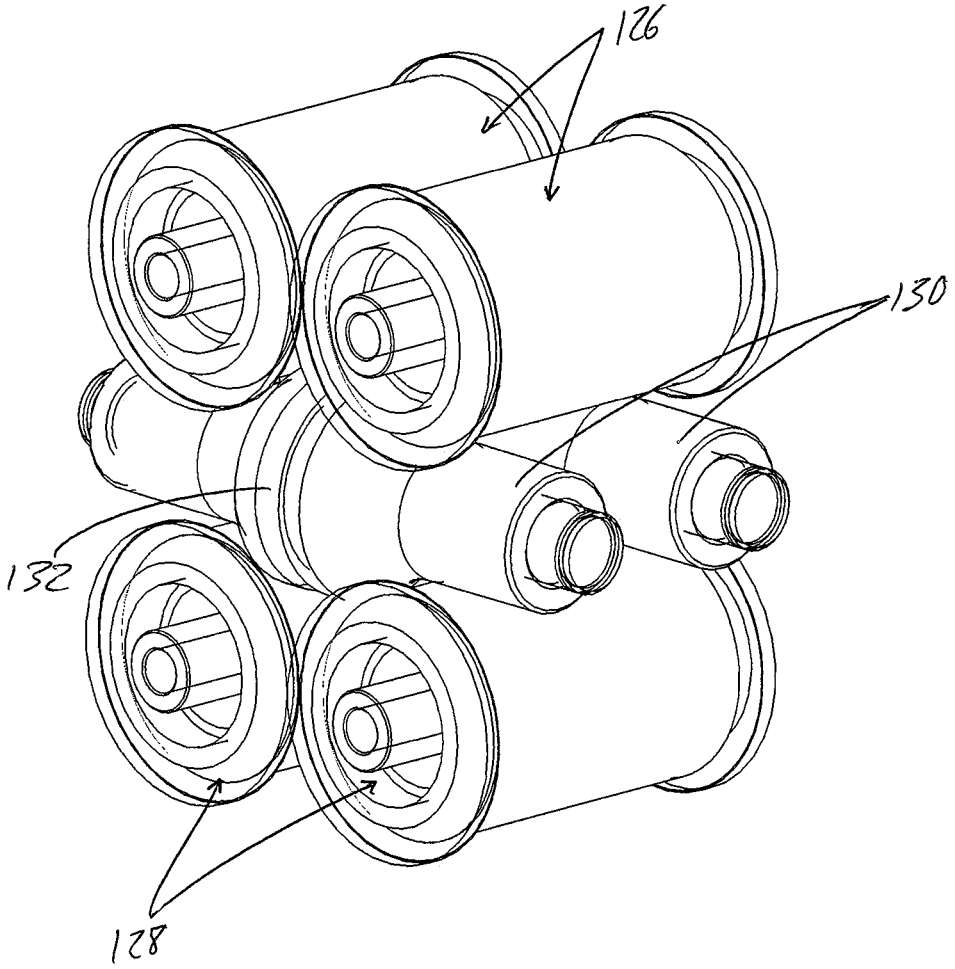
FIG. 15 is a perspective view of a multi-roller layout in a winchline guide unit of the jib of FIGS. 14 and 15.

The guide unit 124 features six rollers arranged in three pairs, as most clearly seen in FIG. 15. A top pair of rollers 126 and a bottom pair of rollers 128 all reside parallel to one another for rotation about horizontal axes that lie parallel to the axis on which the jib 106 pivots relative to the mast 100. In each of these pairs 126, 128, the two rollers reside closely adjacent one another to define a nip through which the winchline is routed. The portion of the guideline routed through the guide unit is thus constrained by the top and bottom rollers 126, 128 against movement perpendicular to the roller axes in the plane of each of these roller pairs 126, 128. A middle pair of rollers 130 have their axes lying perpendicular to those of the top and bottom rollers 126,128 in a plane lying parallel to the planes in which the top roller axes and lower roller axes reside. Each middle roller 130 has a circumferential groove 132 that is aligned in a plane that tangentially bisects the nips of the upper and lower roller pairs. This groove 132 has a suitable width to accommodate and constrain the winchline. The middle rollers 130 thus constrain the portion of the guideline passing through the guide unit in a horizontal direction perpendicular to the direction of constraint effected by the upper and lower rollers 126, 128.

In vertical well applications, where the mast 100 stands substantially vertically and the jib 106 is retracted into parallel and compact relation folded up against the rear side of the mast, the winchline 104 thus runs in a substantially vertical direction down from the origin or routing point 134 near the top of the mast to the guide unit 124 of the jib, and from there, further downward to the unfolded rod guide 10. Accordingly, tension on the winchline 104 pulls upwardly on the rod guide from an elevated point the mast at which the guide unit 124 of the folded-up jib resides. In slant well applications, where the mast is inclined 100 and the jib 106 is deployed fully or partly outward therefrom by collapse of the jib actuator 118 to position the guide unit 124 at an outboard location spaced radially outward from the mast, the winchline 104 runs down to the guide unit 124 of the jib 106 at an oblique downward/rearward angle relative to the inclined mast, and is redirected by its passage through the guide unit 124 of the jib 106 into a more vertically oriented travel path down to the main section 10 of the rod guide 1. As a result, tensioning of the winchline 104 pulls upwardly on the rod guide 10 from the outboard location of the deployed jib's guide unit 124, which lies more directly overhead of the rod guide than the routing/origin point of the winchline located higher up on the mast. This more direct overhead pulling of the rod guide by the winchline better bears the weight of the rod guide without pulling the rod guide forwardly out of its intended position proximate the reel. The jib actuator 118 can be used to adjust the deployment angle of the jib to acquire optimal placement of the guide unit 122 relative to the tether point of the rod guide.

As an alternative to use of the same winchline in both modes of operation, separate winchlines from respective winches may be used for the vertical and slant modes of operation, in which case the elevated point on the mast from which the rod guide is pulled in the vertical mode of use may be the origin/routing point 134 near the top end of the mast, rather than the location of the guide unit 124 on the folded up jib 106. FIG. 12 illustrates the usefulness of the swivel joint 26 in the rod guide 10, where the third main segment 16 and the second section 24 of the second main segment 14, and the extension segment 150 can all be seen to gravitationally hang naturally in a vertical plane from the remainder of the rod guide, whereas the first main segment 12 and the first section 22 of the second main segment 14 lie parallel to the mast in an inclined plane. Although the extension segment 150 is shown in in the same plane as the third main segment, it will be appreciated that the additional swivel joint 160 allows it to swing into any number of different planes to point the mouth 164 of the rod guide in an appropriate direction according to the position of the storage reel. Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. An apparatus for guiding continuous rod into a continuous rod injector, said apparatus comprising:

a plurality of segments each having an arc shape and proximal and distal ends spaced apart along said arc shape, said plurality of segments including:

a first segment connected or connectable to the continuous rod injector at the proximal end of said first segment;

a second segment having a similar length to the first segment, the proximal end of said second segment being pivotally coupled to the distal end of the first segment by a first pivot joint; and a third segment having a shorter length than each of the first and second segments, the proximal end of said third segment being pivotally coupled to the distal end of the second segment by a second pivot joint;

the second segment being movable about the first pivot joint between a stowed position reaching back toward the proximal end of the first segment on a concave side of the arc shape of the first segment and placing the distal end of the second segment adjacent the proximal end of the first segment with a concave side of the second segment facing the concave side of the first segment, and a deployed position extending away from the proximal end of the first segment at the distal end of said first segment to form an extension of the arc shape of the first segment; and the third segment being movable about the second pivot joint between a folded position reaching back toward the proximal end of the second segment on the concave side of the arc shape of the second segment and an unfolded position extending away from the proximal end of the second segment at the distal end thereof to form an extension of the arc shape of the second segment, the third segment being arranged to fit, in the folded position thereof, between the concave sides of the first and second segments in the stowed position of the second segment.

2. The apparatus of claim 1 comprising a first actuator operably connected between the first and second segments to effect movement of the second segment between the stowed and deployed positions, and a second actuator operably connected between the second and third segments to effect movement of the third segment between the folded and unfolded positions.

3. The apparatus of claim 2 wherein the first actuator comprises a first hydraulic linear actuator having opposite ends thereof pinned to the first and second segments, and the second actuator comprises a second hydraulic linear actuator having opposite ends thereof pinned to the second and third segments.

4. The apparatus of claim 1 wherein at least one of the segments comprises separate first and second sections and a swivel connection joining said first and second sections and enabling relative rotation therebetween about a longitudinal axis of said segment.

5. The apparatus of claim 4 wherein said at least one of the segments comprises the second segment, and the first and second actuators are respectively connected to said first and second sections of the second segment on opposite sides of the swivel connection.

6. The apparatus of claim 1 comprising a bracket mounted on the first segment proximate the proximal end thereof and extending to the concave side of the arc shape of the first segment for receiving a proximal portion of the third segment in the folded position when the second segment is moved into the stowed position.

7. The apparatus of claim 1 comprising a bracket mounted on the second segment proximate the proximal end thereof and extending to the concave side of the arc shape of the second segment to receive a distal portion of the third segment in the folded position.

8. The apparatus of claim 6 comprising a second bracket mounted on the second segment proximate the proximal end thereof and extending to the concave side of the arc shape of the second segment to receive a distal portion of the third segment in the folded position.

9. The apparatus of claim 1 wherein each segment comprises hollow tubing of longitudinally arc-shaped curvature and which is sized for passage of the continuous rod longitudinally through said tubing.

10. A method of folding up the apparatus of claim 1 for storage between uses thereof, the method comprising moving the third segment into the folded position relative to the second segment, and moving the second segment into the stowed position relative to the first segment, thereby placing the third second between the concave sides of the first and second segments.

11. A method of unfolding the apparatus of claim 1 for use thereof, the method comprising moving the second segment out of the stowed position into the deployed position, and moving the third segment into the unfolded position, thereby withdrawing the third segment out from between the concave sides of the first and second segments.

12. An apparatus for guiding continuous rod into a continuous rod injector, said apparatus comprising one or more arc-shaped segments defining a guide path for the continuous rod to follow into the continuous rod injector, said one or more arc-shaped segments including a swivel-equipped arc-shaped segment comprising first and second arc-shaped sections joined together at respective ends of said first and second arc-shaped sections by a swivel connection that enables relative rotation between said first and second arc-shaped sections about an axis that lies longitudinally of said first and second sections, whereby through said relative rotation, said swivel connection enables said first and second arc-shaped sections to move between a coplanar relationship contributing a two-dimensional shape to the guide path in a shared singular plane, and a non-coplanar relationship deviating from said shared singular plane and contributing a three-dimensional shape to the guide path.

13. The apparatus of claim 12 comprising an additional swivel joint positioned to reside at a location further along the guide path from the continuous rod injector than the swivel connection of the swivel-equipped segment, said additional swivel joint being coupled between an arc-shaped extension segment and a neighbouring arc-shaped segment by which the arc-shaped extension is connected to the second arc-shaped section of the swivel-equipped arc-shaped segment, and said additional swivel joint enabling relative rotation between said arc-shaped extension and said neighbouring arc-shaped segment about a second axis that lies longitudinally of said arc-shaped extension segment and said neighbouring arc-shaped segment.

14. The apparatus of claim 13 wherein said arc-shaped extension segment defines an open mouth at an end of the guide path opposite the continuous rod injector, whereby the additional swivel joint enables swiveling of the arc-shaped extension segment into and out of coplanar relationship with the neighbouring arc-shaped segment to aim the open mouth of the guide path in different directions.

15. The apparatus of claim 13 wherein the arc-shaped extension segment is assembled from a series of two or more arc-shaped extension sections, each being of lesser length than any of the other segments.

16. A continuous rod guide for guiding continuous rod into a continuous rod injector, said continuous rod guide comprising:

a plurality of segments for cooperatively defining a guide path for the continuous rod to follow into the continuous rod injector, said plurality of segments including a plurality of foldable segments among which at least one pair of adjacent segments are connected by a respective pivot joint and a respective actuator connected between the adjacent segments to effect relative movement thereof between stowed positions folded back along one another and deployed positions forming longitudinal extensions of one another, wherein the plurality of segments are arranged to lie in an upright orientation atop the continuous rod injector when fully folded;

a base to which a first segment of the plurality of segments are connected, said base being mounted or configured for mounting to the continuous rod injector to support the rod guide thereon; and a support seat mounted to the base and comprising an inclined stop situated to a convex side of the first segment in an orientation lying generally tangential thereto when said plurality of segments are fully folded and reside in said upright orientation.

* * * * *